US010495994B2

(12) United States Patent
Yamada et al.

(10) Patent No.: US 10,495,994 B2
(45) Date of Patent: Dec. 3, 2019

(54) LIQUID DEVELOPER

(71) Applicant: Kao Corporation, Tokyo (JP)

(72) Inventors: Tatsuya Yamada, Wakayama (JP); Nobumichi Kamiyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 15/762,854

(22) PCT Filed: May 12, 2016

(86) PCT No.: PCT/JP2016/064150

§ 371 (c)(1),
(2) Date: Mar. 23, 2018

(87) PCT Pub. No.: WO2017/051565

PCT Pub. Date: Mar. 30, 2017

(65) Prior Publication Data

US 2018/0299798 A1 Oct. 18, 2018

(30) Foreign Application Priority Data

Sep. 25, 2015 (JP) ..... 2015-188298

(51) Int. Cl.
*G03G 9/08* (2006.01)
*G03G 9/13* (2006.01)
*G03G 9/125* (2006.01)

(52) U.S. Cl.
CPC ..... *G03G 9/0804* (2013.01); *G03G 9/081* (2013.01); *G03G 9/125* (2013.01); *G03G 9/13* (2013.01); *G03G 9/131* (2013.01); *G03G 9/132* (2013.01); *G03G 9/133* (2013.01)

(58) Field of Classification Search
CPC ..... G03G 9/13; G03G 9/133
See application file for complete search history.

(56) References Cited

U.S. PATENT DOCUMENTS

2003/0219672 A1 11/2003 Tavernier et al.
2007/0197734 A1 8/2007 Matsuoka et al.
2009/0047592 A1* 2/2009 Okamoto ..... G03G 9/08711 430/109.3
2009/0181318 A1 7/2009 Oki et al.
2014/0186764 A1 7/2014 Yamada et al.

FOREIGN PATENT DOCUMENTS

| | | | |
|---|---|---|---|
| EP | 2 749 954 | A1 | 7/2014 |
| JP | 2006-178296 | A | 7/2006 |
| JP | 2007-219229 | A | 8/2007 |
| JP | 2009-186970 | A | 8/2009 |
| JP | 2012-58389 | A | 3/2012 |
| JP | 2013-109237 | A | 6/2013 |
| JP | 2013-114208 | A | 6/2013 |
| JP | 2013-190657 | A | 9/2013 |
| JP | 2014-92579 | A | 5/2014 |
| JP | 2015-145985 | A | 8/2015 |

OTHER PUBLICATIONS

International Search Report dated Aug. 2, 2016 in PCT/JP2016/064150, 2 pages.
Search Report dated Feb. 25, 2019 issued in corresponding European application 16848355.0.

* cited by examiner

*Primary Examiner* — Thorl Chea
(74) *Attorney, Agent, or Firm* — Oblon, McClelland, Maier & Neustadt, L.L.P.

(57) ABSTRACT

A liquid developer containing toner particles containing a resin and a pigment, wherein the toner particles are dispersed in an insulating liquid, wherein the resin contains a resin H having a softening point of 100° C. or higher and a resin L having a softening point of 93° C. or lower, wherein the resin H is a composite resin HC of a polyester resin and a styrenic resin, and the resin L is a polyester resin LP or a composite resin LC of a polyester resin and a styrenic resin, wherein the composite resin HC and the composite resin LC are each a resin in which a polyester resin and a styrenic resin are chemically bonded via a dually reactive monomer, and a method for producing the same. The liquid developer of the present invention is suitably used in development or the like of latent images formed in, for example, electrophotography, electrostatic recording method, electrostatic printing method or the like.

10 Claims, No Drawings

LIQUID DEVELOPER

FIELD OF THE INVENTION

The present invention relates to a liquid developer usable in development of latent images formed in, for example, electrophotography, electrostatic recording method, electrostatic printing method or the like, and a method for producing the same.

BACKGROUND OF THE INVENTION

Electrophotographic developers are a dry developer in which toner components composed of materials containing a colorant and a resin binder are used in a dry state, and a liquid developer in which toner components are dispersed in an insulating liquid.

In a liquid developer, toner particles are dispersed in oil in an insulating liquid, thereby making it possible to form smaller particle sizes as compared to a dry developer. Therefore, high-quality printouts can be obtained surpassing offset printing, so that the liquid developer is suitable for commercial printing applications. In the recent years, with increasing demands for speeding up, liquid developers having lowered viscosities have been desired. In other words, a liquid developer in which toner particles are stably dispersed in a smaller particle size and a lowered viscosity has been desired.

Patent Publication 1 discloses a liquid developer containing a polymeric dispersant obtained by polymerizing an ethylenically unsaturated monomer having an amino group with an ethylenically unsaturated monomer containing an alkyl group having from 4 to 24 carbon atoms, and a plasticizer which is insoluble in a carrier liquid having a melting point of 25° C. or higher, which is intended for providing a liquid developer capable of obtaining stable output images over a long period of time by having excellent fusing ability, offset resistance, and color developability, and also having excellent storage stability.

Patent Publication 2 discloses a liquid developer characterized in that the liquid developer contains toner particles and a basic polymeric dispersant, wherein the toner particles are made of resins containing a vinyl-based copolymer resin composed of styrene which may have one or two alkyl groups having from 1 to 4 carbon atoms and/or an alkyl (meth)acrylate and/or acrylic acid and methacrylic acid, and a polyester resin containing, as an acid component, an aromatic compound having three or more functional groups in a proportion of 5% by mol or more and 50% by mol or less of the entire acid component, wherein the vinyl-based copolymer resin and the polyester resin are contained in a ratio of from 1:9 to 9:1, which is intended for providing a liquid developer which is excellent in both cardboard fusing ability and document offset property.

Patent Publication 1: Japanese Patent Laid-Open No. 2014-92579

Patent Publication 2: Japanese Patent Laid-Open No. 2012-58389

SUMMARY OF THE INVENTION

The present invention relates to:

[1] a liquid developer containing toner particles containing a resin and a pigment, wherein the toner particles are dispersed in an insulating liquid, wherein the above resin contains a resin H having a softening point of 100° C. or higher and a resin L having a softening point of 93° C. or lower, wherein the resin H is a composite resin HC of a polyester resin and a styrenic resin, and the resin L is a polyester resin LP or a composite resin LC of a polyester resin and a styrenic resin, wherein the above composite resin HC and the above composite resin LC are each a resin in which a polyester resin and a styrenic resin are chemically bonded via a dually reactive monomer; and

[2] a method for producing a liquid developer as defined in the above [1], including:

step 1: melt-kneading a resin containing a resin H and a resin L and a pigment, and pulverizing a kneaded product obtained, to provide toner particles;

step 2: adding a dispersant to the toner particles obtained in the step 1, and dispersing the toner particles in a particular insulating liquid to provide a dispersion of toner particles; and step 3: subjecting the dispersion of toner particles obtained in the step 2 to wet-milling, to provide a liquid developer.

DETAILED DESCRIPTION OF THE INVENTION

In the recent years, with increasing demands for speeding up, a toner which is melt-fusible in a smaller heating unit, i.e. a toner having excellent low-temperature fusing ability has been desired. Further, since it is necessary to fuse without causing hot offset even at conventional speeds, toners which are fusible in a wider temperature range have been desired.

However, when the melting properties of the toner are enhanced to improve low-temperature fusing ability, hot offset is likely to take place, thereby making it difficult to obtain a toner fusible in a wider temperature range.

The present invention relates to a liquid developer having a smaller particle size, a lowered viscosity, and being fusible in a wide temperature range, and a method for producing a liquid developer.

The liquid developer of the present invention exhibits some effects that the liquid developer has a smaller particle size and a lowered viscosity, and is fusible in a wide temperature range.

The liquid developer of the present invention is a liquid developer containing toner particles containing a resin and a pigment, wherein the toner particles are dispersed in an insulating liquid, characterized in that the resin contains a resin H having a softening point of 100° C. or higher and a resin L having a softening point of 93° C. or lower, wherein the resin H is a composite resin HC of a polyester resin and a styrenic resin, and the resin L is a polyester resin LP or a composite resin LC of a polyester resin and a styrenic resin, wherein the composite resin HC and the composite resin LC are each a resin in which a polyester resin and a styrenic resin are chemically bonded via a dually reactive monomer, and whereby the liquid developer has a smaller particle size and a lowered viscosity, and is fusible in a wide temperature range.

Although the reasons why such effects are exhibited are not certain, they are considered to be as follows.

By blending a composite resin having a high softening point with a resin having a low softening point, the styrenic resin moiety having a high molecular weight in the composite resin serves to enhance the viscoelasticity of the toner, thereby improving hot offset resistance while maintaining low-temperature fusing ability, whereby widening a fusing range. In addition, it is considered that the intermolecular forces are weaker in the styrenic resin in the composite resin than the polyester resin, so that the resin is likely to pulverize even at a high molecular weight, whereby the wet milling property is improved, and formation of smaller particle sizes is improved. In addition, it is considered that since the intermolecular forces are weaker, the toner particles themselves are less likely to form soft aggregates, so that the viscosity of the liquid developer is also lowered.

[Resin]

The softening point of the resin H is 100° C. or higher, preferably 102° C. or higher, and more preferably 104° C. or higher, from the viewpoint of improving hot offset resistance, and the softening point is preferably 160° C. or lower, more preferably 130° C. or lower, and even more preferably 115° C. or lower, from the viewpoint of improving low-temperature fusing ability of the toner and from the viewpoint of improving wet milling property.

In addition, the softening point of the resin L is preferably 70° C. or higher, more preferably 75° C. or higher, and even more preferably 80° C. or higher, from the viewpoint of improving dispersion stability of the toner particles, thereby improving storage stability, and from the viewpoint of improving hot offset resistance, and the softening point is 93° C. or lower, preferably 91° C. or lower, and more preferably 90° C. or lower, from the viewpoint of improving low-temperature fusing ability of the toner and from the viewpoint of improving wet milling property.

The difference in softening points between the resin H and the resin L is preferably 10° C. or more, and more preferably 14° C. or more, from the viewpoint of allowing the toner to fuse in a wide temperature range, and the difference is preferably 35° C. or less, more preferably 30° C. or less, and even more preferably 20° C. or less, from the viewpoint of homogeneously dispersing the resin, a pigment, and additives in the toner.

The resin H is a composite resin HC of a polyester resin and a styrenic resin, and the resin L is a polyester resin LP or a composite resin LC of a polyester resin and a styrenic resin.

In the composite resin HC and the composite resin LC, it is preferable that the polyester resin is a polycondensate of an alcohol component containing a dihydric or higher polyhydric alcohol and a carboxylic acid component having a dicarboxylic or higher polycarboxylic acid compound. In the description concerning the composite resin, unless specified otherwise, the composite resin hereinafter refers to both the composite resin HC and the composite resin LC.

The dihydric alcohol includes, for example, a diol, and preferably an aliphatic diol, having 2 or more carbon atoms and 20 or less carbon atoms, and preferably 2 or more carbon atoms and 15 or less carbon atoms; an alkylene oxide adduct of bisphenol A represented by the formula (I):

(I)

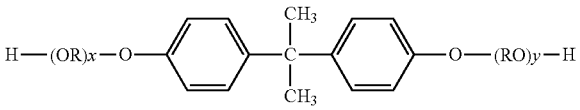

wherein RO and OR are an oxyalkylene group, wherein R is an ethylene group and/or a propylene group; and each of x and y is a positive number showing a number of moles of alkylene oxide added, wherein an average value of the sum of x and y is preferably 1 or more and 16 or less, more preferably 1 or more and 8 or less, and even more preferably 1.5 or more and 4 or less;

and the like. Specific examples of the diol having 2 or more carbon atoms and 20 or less carbon atoms include ethylene glycol, 1,2-propanediol, 1,3-propanediol, 1,4-butanediol, 1,6-hexanediol, bisphenol A, hydrogenated bisphenol A, and the like.

It is preferable that the alcohol component is the alkylene oxide adduct of bisphenol A represented by the formula (I), from the viewpoint of improving low-temperature fusing ability of the toner, and from the viewpoint of improving dispersion stability of the toner particles, thereby improving storage stability. The content of the alkylene oxide adduct of bisphenol A represented by the formula (I) is preferably 50% by mol or more, more preferably 70% by mol or more, even more preferably 90% by mol or more, even more preferably 95% by mol or more, and even more preferably 100% by mol, of the alcohol component.

The trihydric or higher polyhydric alcohol includes trihydric or higher polyhydric alcohols having 3 or more carbon atoms and 20 or less carbon atoms, and preferably 3 or more carbon atoms and 10 or less carbon atoms. Specific examples include sorbitol, 1,4-sorbitan, pentaerythritol, glycerol, trimethylolpropane, and the like.

The content of the dihydric or higher polyhydric alcohol in the composite resin is preferably 50% by mol or more, and more preferably 70% by mol or more, of the alcohol component, from the viewpoint of improving dispersion stability of the toner particles, thereby improving storage stability.

The dicarboxylic acid compound includes, for example, dicarboxylic acids having 3 or more carbon atoms and 30 or less carbon atoms, preferably 3 or more carbon atoms and 20 or less carbon atoms, and more preferably 3 or more carbon atoms and 10 or less carbon atoms, or derivatives such as anhydrides thereof, or alkyl esters thereof, of which alkyl has 1 or more carbon atoms and 3 or less carbon atoms. Specific examples include aromatic dicarboxylic acids such as phthalic acid, isophthalic acid, and terephthalic acid; and aliphatic dicarboxylic acids such as fumaric acid, maleic acid, succinic acid, glutaric acid, adipic acid, sebacic acid, and a succinic acid substituted with an alkyl group having 1 or more carbon atoms and 20 or less carbon atoms or an alkenyl group having 2 or more carbon atoms and 20 or less carbon atoms.

The tricarboxylic or higher polycarboxylic acid compound includes, for example, tricarboxylic or higher polycarboxylic acids having 4 or more carbon atoms and 20 or less carbon atoms, preferably 6 or more carbon atoms and 20 or less carbon atoms, and more preferably 9 or more carbon atoms and 10 or less carbon atoms, or derivatives such as anhydrides thereof, or alkyl esters thereof, of which alkyl has 1 or more carbon atoms and 3 or less carbon atoms. Specific examples include 1,2,4-benzenetricarboxylic acid (trimellitic acid), 1,2,4,5-benzenetetracarboxylic acid (pyromellitic acid), and the like.

As the carboxylic acid component, terephthalic acid or fumaric acid is preferred, and terephthalic acid is more preferred, from the viewpoint of improving chargeability of the toner, and from the viewpoint of improving dispersion stability of the toner particles, thereby improving storage stability. The content of terephthalic acid is preferably 10% by mol or more, more preferably 20% by mol or more, and even more preferably 30% by mol or more, of the carboxylic acid component.

The content of the dicarboxylic or higher polycarboxylic acid compound in the composite resin is preferably 50% by mol or more, and more preferably 70% by mol or more, of the carboxylic acid component, from the viewpoint of improving dispersion stability of the toner particles, thereby improving storage stability.

Here, the alcohol component may contain a monohydric alcohol, and the carboxylic acid component may contain a monocarboxylic acid compound in proper amounts, from the viewpoint of adjusting a molecular weight and a softening point of the polyester resin.

The equivalent ratio of the carboxylic acid component to the alcohol component in the polyester resin, i.e. COOH group or groups/OH group or groups, is preferably 0.70 or more, and more preferably 0.75 or more, and preferably 1.10 or less, and more preferably 1.05 or less, from the viewpoint of adjusting a softening point of the polyester resin.

The polycondensation reaction of the alcohol component and the carboxylic acid component can be carried out in an inert gas atmosphere at a temperature of 180° C. or higher and 250° C. or lower, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like, and the esterification promoter which can be used together with the esterification catalyst includes gallic acid, and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

The styrenic resin is a product of addition polymerization of raw material monomers containing at least styrene or a styrene derivative such as α-methylstyrene or vinyltoluene (hereinafter, the styrene and styrene derivatives are collectively referred to as "styrenic compound").

The content of the styrenic compound, preferably styrene, in the raw material monomers for the styrenic resin, is preferably 50% by mass or more, more preferably 70% by mass or more, and even more preferably 80% by mass or more, from the viewpoint of improving dispersion stability of the toner particles, thereby improving storage stability, and the content is preferably 95% by mass or less, more preferably 93% by mass or less, and even more preferably 90% by mass or less, from the viewpoint of improving low-temperature fusing ability of the toner and from the viewpoint of improving wet milling property.

In addition, the styrenic resin may contain an alkyl (meth)acrylate as a raw material monomer. The alkyl (meth) acrylate includes methyl (meth)acrylate, ethyl (meth)acrylate, (iso)propyl (meth)acrylate, 2-hydroxyethyl (meth)acrylate, (iso or tertiary)butyl (meth)acrylate, 2-ethylhexyl (meth)acrylate, (iso)octyl (meth)acrylate, (iso)decyl (meth) acrylate, (iso)stearyl (meth)acrylate, and the like. These alkyl (meth)acrylates are preferably used alone or in two or more kinds. Here, the expression "(iso or tertiary)" or "(iso)" means to embrace both cases where these groups are present and cases where they are absent, and in the cases where these groups are absent, they are normal form. Also, the expression "(meth)acrylate" means to embrace both acrylate and methacrylate.

The number of carbon atoms of the alkyl group in the alkyl (meth)acrylate is preferably 1 or more, and more preferably 3 or more, and preferably 12 or less, and more preferably 10 or less, from the viewpoint of improving low-temperature fusing ability of the toner. Here, the number of carbon atoms of the alkyl ester refers to the number of carbon atoms derived from the alcohol component constituting the ester.

The raw material monomers for styrene-acrylic resins may contain raw material monomers other than the styrenic compound and the alkyl (meth)acrylate, including, for example, ethylenically unsaturated monoolefins such as ethylene and propylene; diolefins such as butadiene; halovinyls such as vinyl chloride; vinyl esters such as vinyl acetate and vinyl propionate; ethylenically monocarboxylic acid esters such as dimethylaminoethyl (meth)acrylate; vinyl ethers such as vinyl methyl ether; vinylidene halides such as vinylidene chloride; N-vinyl compounds such as N-vinylpyrrolidone; and the like.

The addition polymerization reaction of the raw material monomers for the styrenic resin can be carried out, for example, in accordance with a conventional method in the presence of a polymerization initiator such as dicumyl peroxide, a crosslinking agent, or the like, and in the presence or an organic solvent or in the absence of a solvent, and the temperature conditions are preferably 110° C. or higher, and more preferably 140° C. or higher, and preferably 200° C. or lower, and more preferably 170° C. or lower.

When an organic solvent is used during the addition polymerization reaction, xylene, toluene, methyl ethyl ketone, acetone or the like can be used. The amount of the organic solvent used is preferably 10 parts by mass or more and 50 parts by mass or less, based on 100 parts by mass of the raw material monomers for the styrenic resin.

In the present invention, the composite resin is a resin in which a polyester resin and a styrenic resin are chemically bonded via a dually reactive monomer, which is capable of reacting with both the raw material monomers for the polyester resin and the raw material monomers for the styrenic resin, from the viewpoint of allowing the toner to fuse at a wider temperature range.

The dually reactive monomer is a compound having within its molecule at least one functional group selected from the group consisting of a hydroxyl group, a carboxy group, an epoxy group, a primary amino group and a secondary amino group, preferably a hydroxyl group and/or a carboxy group, and more preferably a carboxy group, and an ethylenically unsaturated bond, and the dually reactive monomer is preferably at least one member selected from the group consisting of acrylic acid, methacrylic acid, fumaric acid, maleic acid, and maleic anhydride, and, from the viewpoint of reactivities of the polycondensation reaction and addition polymerization reaction, more preferably at least one member selected from the group consisting of acrylic acid, methacrylic acid, and fumaric acid. Here, in a case where the dually reactive monomer is used together with a polymerization inhibitor, a polycarboxylic acid compound having an ethylenically unsaturated bond such as fumaric acid functions as a raw material monomer for a polyester resin. In this case, fumaric acid or the like is not a dually reactive monomer, but a raw material monomer for a polyester resin.

The amount of the dually reactive monomer used, based on 100 mol of a total of the alcohol component of the polyester resin, is preferably 1 mol or more, and more preferably 2 mol or more, from the viewpoint of low-temperature fusing ability, and the amount of the dually reactive monomer used is preferably 30 mol or less, more preferably 20 mol or less, and even more preferably 10 mol or less, from the viewpoint of enhancing dispersibility of the styrenic resin and the polyester resin, and improving durability of the toner.

In addition, the amount of the dually reactive monomer used, based on 100 parts by mass of a total of the raw material monomers for the styrenic resin, is preferably 1 part by mass or more, and more preferably 2 parts by mass or more, from the viewpoint of low-temperature fusing ability, and the amount of the dually reactive monomer used is preferably 30 parts by mass or less, more preferably 20 parts by mass or less, and even more preferably 10 parts by mass or less, from the viewpoint of enhancing dispersibility of the styrenic resin and polyester resin, thereby improving durability of the toner. Here, a total of the raw material monomers for the styrenic resin includes a polymerization initiator.

It is preferable that the composite resin obtained by using a dually reactive monomer is specifically produced in accordance with the following method. It is preferable that the dually reactive monomer is used in the addition polymerization reaction together with the raw material monomers for the styrenic resin, from the viewpoint of improving durability of the toner, and from the viewpoint of improving low-temperature fusing ability and heat-resistant storage property of the toner.

(i) Method including the steps of (A) carrying out a polycondensation reaction of raw material monomers for a polyester resin; and thereafter (B) carrying out an addition polymerization reaction of raw materials monomers for a styrenic resin and a dually reactive monomer In this method, the step (A) is carried out under reaction temperature conditions appropriate for a polycondensation reaction, a reaction temperature is then lowered, and the step (B) is carried out under temperature conditions appropriate for an addition polymerization reaction. It is preferable that the raw material monomers for the styrenic resin and the dually reactive monomer are added to a reaction system at a temperature appropriate for an addition polymerization reaction. The dually reactive monomer also reacts with the polyester resin as well as in the addition polymerization reaction.

After the step (B), a reaction temperature is raised again, a raw material monomer which is a trivalent or higher polyvalent monomer for a polyester resin serving as a crosslinking agent is optionally added to the polymerization system, whereby the polycondensation reaction of the step (A) and the reaction with the dually reactive monomer can be further progressed.

(ii) Method including the steps of (B) carrying out an addition polymerization reaction of raw material monomers for a styrenic resin and a dually reactive monomer, and thereafter (A) carrying out a polycondensation reaction of raw material monomers for a polyester resin In this method, the step (B) is carried out under reaction temperature conditions appropriate for an addition polymerization reaction, a reaction temperature is then raised, and the step (A) a polycondensation reaction is carried out under reaction temperature conditions appropriate for the polycondensation reaction. The dually reactive monomer is also involved in a polycondensation reaction as well as the addition polymerization reaction.

The raw material monomers for the polyester resin may be present in a reaction system during the addition polymerization reaction, or the raw material monomers for the polyester resin may be added to a reaction system under temperatures conditions appropriate for the polycondensation reaction. In the former case, the progress of the polycondensation reaction can be adjusted by adding an esterification catalyst at a temperature appropriate for the polycondensation reaction.

(iii) Method including carrying out reactions under the conditions of concurrently progressing the step (A) a polycondensation reaction of raw material monomers for a polyester resin and the step (B) an addition polymerization reaction of raw materials monomers for a styrenic resin and a dually reactive monomer In this method, it is preferable that the steps (A) and (B) are concurrently carried out under reaction temperature conditions appropriate for an addition polymerization reaction, a reaction temperature is raised, a raw material monomer which is a trivalent or higher polyvalent monomer for the polyester resin serving as a crosslinking agent is optionally added to a polymerization system under reaction temperature conditions appropriate for a polycondensation reaction, and the polycondensation reaction of the step (A) is further carried out. During the process, the polycondensation reaction alone can also be progressed by adding a radical polymerization inhibitor under temperature conditions appropriate for the polycondensation reaction. The dually reactive monomer is also involved in a polycondensation reaction as well as the addition polymerization reaction.

In the above method (i), a polycondensation resin that is previously polymerized may be used in place of the step (A) carrying out a polycondensation reaction. In the above method (iii), when the reaction is carried out under the conditions that the steps (A) and (B) are concurrently progressed, a mixture containing raw material monomers for the styrenic resin can be added dropwise to a mixture containing raw material monomers for the polyester resin to react.

It is preferable that the above methods (i) to (iii) are carried out in a single vessel.

The mass ratio of the styrenic resin to the polyester resin in the composite resin, i.e. styrenic resin/polyester resin, is preferably 3/97 or more, more preferably 7/93 or more, and even more preferably 10/90 or more, and preferably 45/55 or less, more preferably 40/60 or less, even more preferably 35/65 or less, even more preferably 30/70 or less, and even more preferably 25/75 or less, from the viewpoint of having excellent low-temperature fusing ability, hot offset resistance, and flowability. Here, in the above calculation, the mass of the polyester resin is an amount in which the amount of reaction water (calculated value) dehydrated by the polycondensation reaction is subtracted from the mass of the raw material monomers for the usable polyester resin, and the amount of the dually reactive monomer is included in the amount of the raw material monomers for the polyester resin. Also, the amount of the styrenic resin is an amount of the raw material monomers for the styrenic resin, and the amount of the polymerization initiator is included therein.

It is preferable that the polyester resin LP is a polycondensate of an alcohol component containing a dihydric or higher polyhydric alcohol and a carboxylic acid component containing a dicarboxylic or higher polycarboxylic acid compound.

The alcohol component includes the same alcohols as the alcohol component of the polyester resin of the above composite resin HC.

The dihydric alcohol includes, for example, diols, and preferably aliphatic diols, having 2 or more carbon atoms and 20 or less carbon atoms, preferably 2 or more carbon atoms and 15 or less carbon atoms; and an alkylene oxide adduct of bisphenol A represented by the formula (I) defined above, and the like. Specific examples of the diols having 2 or more carbon atoms and 20 or less carbon atoms include ethylene glycol, 1,2-propanediol, 1,3-propanediol, 1,4-butanediol, 1,6-hexanediol, bisphenol A, hydrogenated bisphenol A, and the like.

It is preferable that the alcohol component is the alkylene oxide adduct of bisphenol A represented by the formula (I), from the viewpoint of improving low-temperature fusing ability of the toner, and from the viewpoint of improving dispersion stability of the toner particles, thereby improving storage stability. The content of the alkylene oxide adduct of bisphenol A represented by the formula (I) is preferably 50% by mol or more, more preferably 70% by mol or more, even more preferably 90% by mol or more, even more preferably 95% by mol or more, and even more preferably 100% by mol, of the alcohol component.

The trihydric or higher polyhydric alcohol includes trihydric or higher polyhydric alcohols having 3 or more carbon atoms and 20 or less carbon atoms, and preferably 3 or more carbon atoms and 10 or less carbon atoms. Specific examples include sorbitol, 1,4-sorbitan, pentaerythritol, glycerol, trimethylolpropane, and the like.

The content of the dihydric or higher polyhydric alcohol in the polyester resin LP is preferably 50% by mol or more, and more preferably 70% by mol or more, of the alcohol component, from the viewpoint of improving dispersion stability of the toner particles, thereby improving storage stability.

The dicarboxylic acid compound includes, for example, dicarboxylic acids having 3 or more carbon atoms and 30 or less carbon atoms, preferably 3 or more carbon atoms and 20 or less carbon atoms, and more preferably 3 or more carbon atoms and 10 or less carbon atoms, or derivatives thereof such as anhydrides thereof, alkyl esters of which alkyl has 1 or more carbon atoms and 3 or less carbon atoms, and the like. Specific examples include aromatic dicarboxylic acids such as phthalic acid, isophthalic acid, and terephthalic acid; and aliphatic dicarboxylic acids such as fumaric acid, maleic acid, succinic acid, glutaric acid, adipic acid, sebacic acid, and a succinic acid substituted with an alkyl group having 1 or more carbon atoms and 20 or less carbon atoms or an alkenyl group having 2 or more carbon atoms and 20 or less carbon atoms.

The tricarboxylic or higher polycarboxylic acid compound includes, for example, tricarboxylic or higher polycarboxylic acids having 4 or more carbon atoms and 20 or less carbon atoms, preferably 6 or more carbon atoms and 20 or less carbon atoms, and more preferably 9 or more carbon atoms and 10 or less carbon atoms, or derivatives thereof such as anhydrides thereof, alkyl esters of which alkyl has 1 or more carbon atoms and 3 or less carbon atoms, and the like. Specific examples include 1,2,4-benzenetricarboxylic acid (trimellitic acid), 1,2,4,5-benzenetetracarboxylic acid (pyromellitic acid), and the like.

The carboxylic acid component is preferably terephthalic acid or fumaric acid, and more preferably terephthalic acid, from the viewpoint of improving chargeability of the toner, and from the viewpoint of improving dispersion stability of the toner particles, thereby improving storage stability. The content of terephthalic acid is preferably 30% by mol or more, more preferably 50% by mol or more, and even more preferably 70% by mol or more, of the carboxylic acid component.

The content of the dicarboxylic or higher polycarboxylic acid compound in the polyester resin LP is preferably 50% by mol or more, and more preferably 70% by mol or more, of the carboxylic acid component, from the viewpoint of improving dispersion stability of the toner particles, thereby improving storage stability.

Here, the alcohol component may contain a monohydric alcohol, and the carboxylic acid component may contain a monocarboxylic acid compound in proper amounts, from the viewpoint of adjusting a molecular weight and a softening point of the polyester resin.

The equivalent ratio of the carboxylic acid component to the alcohol component in the polyester resin LP, i.e. COOH group or groups/OH group or groups, is preferably 0.70 or more, and more preferably 0.75 or more, and preferably 1.10 or less, and more preferably 1.05 or less, from the viewpoint of adjusting a softening point of the polyester resin.

The polycondensation reaction of the alcohol component and the carboxylic acid component can be carried out in an inert gas atmosphere at a temperature of 180° C. or higher and 250° C. or lower or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like, and the esterification promoter which can be used together with the esterification catalyst includes gallic acid, and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

Here, in the present invention, the polyester resin LP may be a modified polyester to an extent that the properties thereof are not substantially impaired. The modified polyester includes, for example, a polyester grafted or blocked with a phenol, a urethane, an epoxy or the like according to a method described in Japanese Patent Laid-Open No. Hei-11-133668, Hei-10-239903, Hei-8-20636, or the like.

The glass transition temperature of the resin H is preferably 40° C. or higher, more preferably 45° C. or higher, and even more preferably 50° C. or higher, from the viewpoint of improving durability of the toner, and the glass transition temperature is preferably 70° C. or lower, more preferably 65° C. or lower, and even more preferably 60° C. or lower, from the viewpoint of improving low-temperature fusing ability of the toner.

The acid value of the resin H is preferably 5 mgKOH/g or more, more preferably 10 mgKOH/g or more, and even more preferably 20 mgKOH/g or more, from the viewpoint of improving chargeability of the toner, and the acid value is preferably 60 mgKOH/g or less, more preferably 50 mgKOH/g or less, and even more preferably 40 mgKOH/g or less, from the viewpoint of improving dispersion stability of the toner particles, thereby improving storage stability.

The glass transition temperature of the resin L is preferably 35° C. or higher, more preferably 40° C. or higher, and even more preferably 50° C. or higher, from the viewpoint of improving durability of the toner, and the glass transition temperature is preferably 65° C. or lower, more preferably 60° C. or lower, and even more preferably 55° C. or lower, from the viewpoint of improving low-temperature fusing ability of the toner.

The acid value of the resin L is preferably 3 mgKOH/g or more, more preferably 5 mgKOH/g or more, and even more preferably 10 mgKOH/g or more, from the viewpoint of improving chargeability of the toner, and the acid value is preferably 50 mgKOH/g or less, more preferably 40 mgKOH/g or less, and even more preferably 20 mgKOH/g or less, from the viewpoint of improving dispersion stability of the toner particles, thereby improving storage stability.

The mass ratio of the resin H to the resin L, i.e., resin H/resin L, is preferably 2/8 or more, more preferably 3/7 or more, and even more preferably 4/6 or more, from the viewpoint of improving hot offset resistance, and the mass ratio is preferably 8/2 or less, more preferably 7/3 or less, and even more preferably 6/4 or less, from the viewpoint of improving low-temperature fusing ability of the toner and from the viewpoint of improving wet milling property.

A total amount of the resin H and the resin L is preferably 80% by mass or more, more preferably 90% by mass or more, even more preferably 95% by mass or more, and even more preferably 100% by mass, of the resins.

[Pigment]

As the pigment, all the pigments which are used as colorants for toners can be used, and carbon blacks, Phthalocyanine Blue, Permanent Brown F G, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. In the present invention, the toner particles may be any one of black toners and color toners.

The content of the pigment is preferably 100 parts by mass or less, more preferably 70 parts by mass or less, even more preferably 50 parts by mass or less, and even more preferably 30 parts by mass or less, based on 100 parts by mass of the resin, from the viewpoint of improving pulverizability of the toner particles, thereby making it possible to form smaller particle sizes, from the viewpoint of improving low-temperature fusing ability, and from the viewpoint of improving dispersion stability of the toner particles, thereby improving storage stability, and the content is preferably 5 parts by mass or more, more preferably 10 parts by mass or more, and even more preferably 15 parts by mass or more, based on 100 parts by mass of the resin, from the viewpoint of improving optical density.

In the present invention, as toner raw materials, an additive such as a releasing agent, a charge control agent, a charge control resin, a magnetic particulate, a flowability improver, an electric conductivity modifier, a reinforcing filler such as a fibrous material, an antioxidant, or a cleanability improver may be further properly used.

[Method for Producing Toner Particles]

The method for obtaining toner particles includes a method including melt-kneading toner raw materials containing a resin and a pigment, and pulverizing the melt-kneaded product obtained; a method including mixing an aqueous resin dispersion and an aqueous pigment dispersion, thereby unifying the resin particles and the pigment particles; a method including stirring an aqueous resin dispersion and a pigment at a high speed; and the like. The method including melt-kneading toner raw materials, and pulverizing the melt-kneaded product obtained is preferred, from the viewpoint of improving developing ability and fusing ability.

It is preferable that the toner raw materials containing a resin and a pigment are previously mixed with a mixer such as a Henschel mixer, a Super mixer or a ball-mill, and the mixture is then fed to a kneader, and, from the viewpoint of improving pigment dispersibility in the resin, more preferably with a Henschel mixer.

The mixing with a Henschel mixer is carried out with adjusting a peripheral speed of agitation, and a mixing time. The peripheral speed is preferably 10 m/sec or more and 30 m/sec or less, from the viewpoint of improving pigment dispersibility. In addition, the agitation time is preferably 1 minute or more and 10 minutes or less, from the viewpoint of improving pigment dispersibility.

Next, the melt-kneading of toner raw materials can be carried out with a known kneader, such as a tightly closed kneader, a single-screw or twin-screw kneader, or a continuous open-roller type kneader. In the method for production of the present invention, an open-roller type kneader is preferred, from the viewpoint of improving pigment dispersibility, and from the viewpoint of improving an yield of the toner particles after pulverization.

The open-roller type kneader refers to a kneader of which kneading unit is an open type, not being tightly closed, by which the kneading heat generated during the melt-kneading can be easily dissipated. The open-roller type kneader used in the present invention is provided with a plurality of feeding ports for raw materials and a discharging port for a kneaded mixture along the shaft direction of the roller. It is preferable that the open roller-kneader is a continuous open roller-type kneader, from the viewpoint of production efficiency.

It is preferable that the open-roller type kneader comprises at least two kneading rollers having different temperatures. The temperature of the roller can be adjusted by, for example, a temperature of a heating medium passing through the inner portion of the roller, and each roller may be divided in two or more portions in the inner portion of the roller, each being passed through with heating media of different temperatures.

The temperature at an end of the raw material supplying side of the high-rotating roller is preferably 80° C. or higher and 160° C. or lower, from the viewpoint of reducing mechanical forces during melt-kneading, thereby controlling the generation of heat, and from the viewpoint of improving dispersibility of the pigment into the polyester resin, and the temperature at an end of the raw material supplying side of the low-rotating roller is preferably 30° C. or higher and 100° C. or lower, from the same viewpoint.

The high-rotating roller has a difference in the set temperatures between an end part of the raw material supplying side and an end part of the kneaded product discharge of preferably 2° C. or more, and preferably 60° C. or less, more preferably 50° C. or less, and even more preferably 30° C. or less, from the viewpoint of preventing detachment of the kneaded product from the roller, from the viewpoint of reducing mechanical forces during melt-kneading, thereby controlling heat generation, and from the viewpoint of improving dispersibility of the pigment into the polyester resin. The low-rotating roller has a difference in the set temperatures between an end part of the raw material supplying side and an end part of the kneaded product discharge of preferably 50° C. or less, more preferably 30° C. or less, and may be 0° C., from the viewpoint of reducing mechanical forces during melt-kneading, thereby controlling heat generation, and from the viewpoint of improving dispersibility of the pigment into the resin.

It is preferable that the rollers are those having peripheral speeds that are different from each other. In the open roller-type kneader provided with the above two rollers, it is preferable that the heat roller having a higher temperature is a high-rotation roller, and that the cooling roller having a lower temperature is a low-rotation roller, from the viewpoint of improving dispersibility of the pigment into the resin.

The peripheral speed of the high-rotation roller is preferably 2 m/min or more, and more preferably from 5 m/min or more, and preferably 100 m/min or less, and more preferably 75 m/min or less. Also, the ratio of the peripheral speeds of the two rollers, i.e. low-rotation roller/high-rotation roller, is preferably from 1/10 to 9/10, and more preferably from 3/10 to 8/10.

The gap between the two rollers, i.e. clearance, at an end part on the upstream side of the kneading is preferably 0.1 mm or more, and preferably 3 mm or less, and more preferably 1 mm or less.

In addition, structures, size, materials and the like of each of the rollers are not particularly limited. The surface of the roller comprises a groove used in kneading, and the shapes of grooves include linear, spiral, wavy, rugged or other forms.

The feeding rates and the average residence time of the raw material mixture differ depending upon the size of the rollers used, components of the raw materials, and the like, so that optimal conditions among these conditions may be selected.

Next, the kneaded product is cooled to an extent that is pulverizable, and the obtained mixture is then subjected to a pulverizing step and optionally a classifying step, whereby the toner particles can be obtained.

The pulverizing step may be carried out in divided multi-stages. For example, the melt-kneaded product may be roughly pulverized to a size of from 1 to 5 mm or so, and the roughly pulverized product may then be further finely pulverized. In addition, in order to improve productivity during the pulverizing step, the melt-kneaded product may be mixed with fine inorganic particles made of hydrophobic silica or the like, and then pulverized.

The pulverizer suitably used in the rough pulverization includes an atomizer, Rotoplex, and the like, or a hammermill or the like may be used. Also, the pulverizer suitably used in the fine pulverization includes a fluidised bed opposed jet mill, an air jet mill, a rotary mechanical mill, and the like.

The classifier usable in the classification step includes an air classifier, a rotor type classifier, a sieve classifier, and the like. Here, the pulverizing step and the classifying step may be repeated as occasion demands.

The toner particles obtained in this step have a volume-median particle size $D_{50}$ of preferably 3 μm or more, and more preferably 4 μm or more, and preferably 15 μm or less, and more preferably 12 μm or less, from the viewpoint of improving productivity of the wet-milling step described later. Here, the volume-median particle size $D_{50}$ means a particle size of which cumulative volume frequency calculated on a volume percentage is 50% counted from the smaller particle sizes.

[Method for Producing Liquid Developer]

The toner particles are dispersed in an insulating liquid in the presence of a dispersant to provide a liquid developer. It is preferable that the toner particles are dispersed in an insulating liquid, and thereafter the toner particles are subjected to wet-milling to provide a liquid developer, from the viewpoint of making particle sizes of the toner particles in the liquid developer smaller, and from the viewpoint of reducing viscosity of the liquid developer.

[Insulating Liquid]

The insulating liquid means a liquid through which electricity is less likely to flow, and in the present invention, the conductivity of the insulating liquid is preferably $1.0\times10^{-11}$ S/m or less, and more preferably $5.0\times10^{-12}$ S/m or less. In addition, it is preferable that the dielectric constant of the insulating liquid is 3.5 or less.

Specific examples of the insulating liquid include, for example, hydrocarbon solvents such as aliphatic hydrocarbons, alicyclic hydrocarbons, aromatic hydrocarbons, and halogenated hydrocarbons, polysiloxanes, vegetable oils, and the like, and one or more members selected from the group consisting of hydrocarbon solvents and polysiloxanes are preferred, among which the hydrocarbon solvents are more preferred, from the viewpoint of low-temperature fusing ability, and the aliphatic hydrocarbons are even more preferred, from the viewpoint of being low in viscosity and having excellent balance between wet-milling property, low-temperature fusing ability, environmental safety, and storage stability. The aliphatic hydrocarbon includes paraffinic hydrocarbons, olefins having 12 or more carbon atoms and 18 or less carbon atoms, and the like. The hydrocarbon solvents can be used alone or in a combination of two or more of them. Among the aliphatic hydrocarbons, the paraffinic hydrocarbons are preferred, from the viewpoint of improving storage stability of the toner particles in the liquid developer, thereby improving low-temperature fusing ability of the liquid developer, and from the viewpoint of increasing resistance, and a polyisobutene richly containing methyl groups at the terminals is preferred.

The polyisobutene can be obtained by polymerizing isobutene in accordance with a known method, for example, a cationic polymerization method using a catalyst.

The catalyst usable in the cationic polymerization method includes, for example, aluminum chloride, an acidic ion-exchanging resin, sulfuric acid, boron fluoride, and complexes thereof, and the like. In addition, the polymerization reaction can be controlled by adding a base to the above catalyst.

It is preferable that an unreacted component of isobutene or a high-boiling point component having a high degree of polymerization, produced during the polymerization reaction, is removed by distillation. The method of distillation includes, for example, a simple distillation method, a continuous distillation method, a steam distillation method, and the like, and these methods can be used alone or in a combination. The apparatuses used in distillation are not particularly limited in materials, shapes, models, and the like, which include a distillation tower packed with a filler material such as Raschig ring, a shelved distillation tower comprising dish-shaped shelves, and the like. In addition, the theoretical number of shelves showing separating ability of the distillation tower is preferably 10 shelves or more. Besides, conditions such as feeding rates to the distillation tower, refluxing ratios, and uptake amounts can be appropriately selected depending upon the distillation apparatuses.

Since a formed product obtained by the polymerization reaction has a double bond at a polymerization terminal, a hydrogenated compound is obtained by a hydrogenation reaction. The hydrogenation reaction can be carried out by, for example, contacting with hydrogen under a pressure of from 2 to 10 MPa at a temperature of from 180° to 230° C. using a hydrogenation catalyst such as nickel or palladium.

Commercially available products of the insulating liquid containing a polyisobutene include "NAS-3," "NAS-4," "NAS-5H," hereinabove manufactured by NOF Corporation, and the like. Among them, the commercially available products can be used alone or in a combination of two or more kinds.

The content of the hydrocarbon solvent is preferably 60% by mass or more, more preferably 80% by mass or more, even more preferably 90% by mass or more, even more preferably 95% by mass or more, and even more preferably 100% by mass, of the insulating liquid.

The boiling point of the insulating liquid is preferably 120° C. or higher, more preferably 140° C. or higher, and even more preferably 160° C. or higher, from the viewpoint of even more improving dispersion stability of the toner particles, thereby improving storage stability, and the boiling point is 300° C. or lower, preferably 280° C. or lower, and more preferably 260° C. or lower, from the viewpoint of even more improving low-temperature fusing ability of the toner, from the viewpoint of even more improving pulverizability of the toner during wet-milling, thereby providing a liquid developer having a smaller particle size, and from the viewpoint of controlling the generation of the dispersant steam. When the insulating liquids are used in combination of two or more kinds, it is preferable that a boiling point of a combined insulating liquid mixture is within the above range.

The viscosity of the insulating liquid at 25° C. is preferably 0.01 mPa·s or more, more preferably 0.3 mPa·s or more, even more preferably 0.5 mPa·s or more, and even more preferably 0.7 mPa·s or more, from the viewpoint of improving dispersion stability of the toner particles, thereby even more improving storage stability, and the viscosity is preferably 5 mPa·s or less, more preferably 4 mPa·s or less, and even more preferably 3 mPa·s or less, from the viewpoint of even more improving low-temperature fusing ability, and from the viewpoint of even more improving pulverizability of the toner during wet-milling, thereby providing a liquid developer having a smaller particle size. When the insulating liquids are used in combination of two or more kinds, it is preferable that a viscosity of a combined insulating liquid mixture is within the above range.

The blending amount of the toner particles, based on 100 parts by mass of the insulating liquid, is preferably 10 parts by mass or more, and more preferably 20 parts by mass or more, from the viewpoint of high-speed printing ability, and the blending amount is preferably 100 parts by mass or less, and more preferably 80 parts by mass or less, from the viewpoint of improving dispersion stability.

[Dispersant]

The liquid developer of the present invention contains a dispersant, from the viewpoint of improving dispersion stability of the toner particles, thereby improving storage stability, and from the viewpoint of improving pulverizability of the toner particles during wet-milling, thereby providing a liquid developer having a smaller particle size. The dispersant is used for stably dispersing the toner particles in an insulating liquid. It is preferable that the liquid developer of the present invention contains a basic dispersant having a basic adsorbing group, from the viewpoint of improving adsorbability to the resin, particularly the polyester resin. As the basic dispersant, a condensate of a polyimine and a carboxylic acid is preferred.

As the polyimine, an polyalkyleneimine is preferred, from the viewpoint of improving dispersion stability of the toner particles, thereby improving storage stability. Specific examples include polyethyleneimine, polypropyleneimine, polybutyleneimine, and the like. The polyethyleneimine is more preferred, from the viewpoint of improving dispersion stability of the toner particles, thereby improving storage stability. The number of moles of ethyleneimine added is preferably 10 or more, and more preferably 100 or more, and preferably 1,000 or less, and more preferably 500 or less.

On the other hand, the carboxylic acid is preferably a saturated or unsaturated aliphatic carboxylic acid, more preferably a linear, saturated or unsaturated aliphatic carboxylic acid, having preferably 10 or more carbon atoms and 30 or less carbon atoms, more preferably 12 or more carbon atoms and 24 or less carbon atoms, and even more preferably 16 or more carbon atoms and 22 or less carbon atoms, from the viewpoint of improving dispersion stability of the toner particles, thereby improving storage stability. Specific carboxylic acids include linear saturated aliphatic carboxylic acids such as lauric acid, myristic acid, palmitic acid, and stearic acid; and linear, unsaturated aliphatic carboxylic acids such as oleic acid, linoleic acid, and linolenic acid, and the like.

In addition, the carboxylic acid may have a substituent such as a hydroxy group. The carboxylic acid is preferably a hydroxycarboxylic acid, having a hydroxy group as a substituent, from the viewpoint of improving dispersion stability of the toner particles, thereby improving storage stability. The hydroxycarboxylic acid includes hydroxycarboxylic acids such as mevalonic acid, ricinoleic acid, and 12-hydroxystearic acid, and the like. The hydroxycarboxylic acid may be a condensate thereof.

From the above viewpoint, the carboxylic acid is preferably a hydroxyaliphatic carboxylic having preferably 10 or more carbon atoms and 30 or less carbon atoms, more preferably 12 or more carbon atoms and 24 or less carbon atoms, and even more preferably 16 or more carbon atoms and 22 or less carbon atoms, or a condensate thereof, and more preferably 12-hydroxystearic acid or a condensate thereof.

Specific examples of the condensate include SOLSPARSE 11200 and SOLSPARSE 13940, hereinabove both manufactured by Lubrizol Corporation, and the like.

The weight-average molecular weight of the condensate is preferably 2,000 or more, more preferably 4,000 or more, and even more preferably 8,000 or more, from the viewpoint of improving dispersion stability of the toner particles, thereby improving storage stability, and the weight-average molecular weight is preferably 50,000 or less, more preferably 40,000 or less, and even more preferably 30,000 or less, from the viewpoint of pulverizability of the toner.

The content proportion of the condensate in the dispersant is preferably 50% by mass or more, more preferably 70% by mass or more, even more preferably 90% by mass or more, even more preferably substantially 95% by mass, and even more preferably 100% by mass, from the viewpoint of controlling the aggregation of the toner particles, thereby lowering the viscosity of the liquid developer, and from the viewpoint of improving pulverizability of the toner particles during wet-milling, thereby providing a liquid developer having a smaller particle size.

The dispersant other than the condensate of a polyimine and a carboxylic acid includes copolymers of alkyl methacrylate/amino group-containing methacrylate, copolymers of α-olefin/vinyl pyrrolidone (Antaron V-216), and the like.

The amount of the dispersant as an effective ingredient, based on 100 parts by mass of the toner particles, is preferably 0.5 parts by mass or more, more preferably 1 part by mass or more, and even more preferably 2 parts by mass or more, from the viewpoint of controlling the aggregation of the toner particles, thereby lowering the viscosity of the liquid developer, and the amount is preferably 20 parts by mass or less, more preferably 15 parts by mass or less, even more preferably 10 parts by mass or less, and even more preferably 5 parts by mass or less, from the viewpoint of improving developing ability and fusing ability.

It is preferable that a method for mixing toner particles, an insulating liquid, and a dispersant is a method including stirring the components with an agitation mixer, or the like.

The agitation mixer is, but not particularly limited to, preferably high-speed agitation mixers, from the viewpoint of improving productivity and storage stability of the dispersion of toner particles. Specific examples are preferably DESPA manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX manufactured by M Technique Co., Ltd.; KADY Mill manufactured by KADY International, and the like.

The toner particles are previously dispersed by mixing components with a high-speed agitation mixer, whereby a dispersion of toner particles can be obtained, which in turn improves productivity of a liquid developer by the subsequent wet-milling.

The solid content concentration of the dispersion of toner particles is preferably 20% by mass or more, more preferably 30% by mass or more, and even more preferably 33% by mass or more, from the viewpoint of improving optical density, and the solid content concentration is preferably 50% by mass or less, more preferably 45% by mass or less, and even more preferably 40% by mass or less, from the viewpoint of improving dispersion stability of the toner particles, thereby improving storage stability.

[Wet-Milling]

The wet-milling refers to a method of subjecting toner particles dispersed in an insulating liquid to a mechanical milling treatment in the state of dispersion in the insulating liquid.

As the apparatus used, for example, generally used agitation mixers such as anchor blades can be used. The agitation mixers include high-speed agitation mixers such as DESPA manufactured by ASADA IRON WORKS CO., LTD., and T.K. HOMOGENIZING MIXER manufactured by PRIMIX Corporation; pulverizers or kneaders, such as roller mills, beads-mills, kneaders, and extruders; and the like. These apparatuses can be used in a combination of plural apparatuses.

Among these apparatuses, use of beads-mill is preferred, from the viewpoint of making particle sizes of toner particles smaller, from the viewpoint of improving dispersion stability of the toner particles, thereby improving storage stability, and from the viewpoint of lowering the viscosity of the dispersion.

By controlling particle sizes and filling ratios of media used, peripheral speeds of rotors, residence time, or the like in the beads-mill, toner particles having a desired particle size and a particle size distribution can be obtained.

As described above, it is preferable that the liquid developer of the present invention is produced by a method including:

step 1: melt-kneading a resin containing a resin H and a resin L and a pigment, and pulverizing a kneaded product obtained, to provide toner particles;

step 2: adding a dispersant to the toner particles obtained in the step 1, and dispersing the toner particles in a specified insulating liquid to provide a dispersion of toner particles; and step 3: subjecting the dispersion of toner particles obtained in the step 2 to wet-milling, to provide a liquid developer.

The solid content concentration of the liquid developer is preferably 10% by mass or more, more preferably 15% by mass or more, and even more preferably 20% by mass or more, from the viewpoint of improving optical density, and the solid content concentration is preferably 50% by mass or less, more preferably 45% by mass or less, and even more preferably 40% by mass or less, from the viewpoint of improving dispersion stability of the toner particles, thereby improving storage stability.

The volume-median particle size $D_{50}$ of the toner particles in the liquid developer is preferably 3.0 μm or less, more preferably 2.7 μm or less, and even more preferably 2.5 μm or less, from the viewpoint of improving image quality of the liquid developer, and the volume-median particle size is preferably 0.5 μm or more, more preferably 1.0 μm or more, and even more preferably 1.5 μm or more, from the viewpoint of lowering the viscosity of the liquid developer.

The viscosity of the liquid developer at 25° C. is preferably 30 mPa·s or less, more preferably 25 mPa·s or less, and even more preferably 20 mPa·s or less, from the viewpoint of improving fusing ability of the liquid developer, and the viscosity is preferably 3 mPa·s or more, more preferably 5 mPa·s or more, even more preferably 6 mPa·s or more, and even more preferably 7 mPa·s or more, from the viewpoint of improving dispersion stability of the toner particles, thereby improving storage stability.

With regard to the embodiments described above, the present invention further discloses the following liquid developers and the methods for producing the same.

<1> A liquid developer containing toner particles containing a resin and a pigment, wherein the toner particles are dispersed in an insulating liquid, wherein the resin contains a resin H having a softening point of 100° C. or higher and a resin L having a softening point of 93° C. or lower, wherein the resin H is a composite resin HC of a polyester resin and a styrenic resin, and the resin L is a polyester resin LP or a composite resin LC of a polyester resin and a styrenic resin, wherein the above composite resin HC and the above composite resin LC are each a resin in which a polyester resin and a styrenic resin are chemically bonded via a dually reactive monomer.

<2> The liquid developer according to the above <1>, wherein the resin L is a composite resin LC.

<3> The liquid developer according to the above <1> or <2>, wherein a difference in softening points between the resin H and the resin L is 10° C. or more, and preferably 14° C. or more, and 35° C. or less, preferably 30° C. or less, and more preferably 20° C. or less.

<4> The liquid developer according to any one of the above <1> to <3>, wherein a mass ratio of the resin H to the resin L, resin H/resin L, is 2/8 or more, preferably 3/7 or more, and more preferably 4/6 or more, and 8/2 or less, preferably 7/3 or less, and more preferably 6/4 or less.

<5> The liquid developer according to any one of the above <1> to <4>, wherein the softening point of the resin H is 100° C. or higher, preferably 102° C. or higher, and more preferably 104° C. or higher, and 160° C. or lower, preferably 130° C. or lower, and more preferably 115° C. or lower.

<6> The liquid developer according to any one of the above <1> to <5>, wherein the softening point of the resin L is 70° C. or higher, preferably 75° C. or higher, and more preferably 80° C. or higher, and 93° C. or lower, preferably 91° C. or lower, and more preferably 90° C. or lower.

<7> The liquid developer according to any one of the above <1> to <6>, wherein the polyester resin in the composite resin HC and the composite resin LC is a polycondensate of an alcohol component containing a dihydric or higher polyhydric alcohol and a carboxylic acid component containing a dicarboxylic or higher polycarboxylic acid compound.

<8> The liquid developer according to the above <7>, wherein the alcohol component contains at least one dihydric alcohol selected from a diol, and preferably an aliphatic diol, having 2 or more carbon atoms and 20 or less carbon atoms, and preferably 2 or more carbon atoms and 15 or less carbon atoms; and an alkylene oxide adduct of bisphenol A represented by the formula (I) defined above.

<9> The liquid developer according to the above <7> or <8>, wherein the carboxylic acid component contains at least one dicarboxylic acid compound selected from the group consisting of dicarboxylic acids having 3 or more carbon atoms and 30 or less carbon atoms, preferably 3 or more carbon atoms and 20 or less carbon atoms, and more preferably 3 or more carbon atoms and 10 or less carbon atoms, acid anhydrides thereof, and alkyl esters of which alkyl has 1 carbon atom or more and 3 carbon atoms or less.

<10> The liquid developer according to any one of the above <7> to <9>, wherein the carboxylic acid component contains at least one tricarboxylic or higher polycarboxylic acid compound selected from the group consisting of tricarboxylic or higher polycarboxylic acids having 4 or more carbon atoms and 20 or less carbon atoms, preferably 6 or more carbon atoms and 20 or less carbon atoms, and more preferably 9 or more carbon atoms and 10 or less carbon atoms, acid anhydrides thereof, and alkyl esters of which alkyl has 1 carbon atom or more and 3 carbon atoms or less.

<11> The liquid developer according to any one of the above <1> to <10>, wherein the dually reactive monomer is a compound having within its molecule at least one functional group selected from the group consisting of a hydroxyl group, a carboxy group, an epoxy group, a primary amino group and a secondary amino group, preferably a hydroxyl group and/or a carboxy group, and more preferably a carboxy group, and an ethylenically unsaturated bond.

<12> The liquid developer according to any one of the above <1> to <10>, wherein the dually reactive monomer is at least one member selected from the group consisting of acrylic acid, methacrylic acid, fumaric acid, maleic acid, and maleic anhydride, and preferably at least one member selected from the group consisting of acrylic acid, methacrylic acid, and fumaric acid.

<13> The liquid developer according to any one of the above <1> to <12>, wherein the insulating liquid is at least one member selected from the group consisting of hydrocarbon solvents, polysiloxanes, and vegetable oils, preferably one or more members selected from the group consisting of hydrocarbon solvents and polysiloxanes, more preferably the hydrocarbon solvents, and even more preferably the aliphatic hydrocarbons.

<14> The liquid developer according to any one of the above <1> to <13>, wherein the content of the pigment, based on 100 parts by mass of the resin, is 100 parts by mass or less, preferably 70 parts by mass or less, more preferably 50 parts by mass or less, and even more preferably 30 parts by mass or less, and 5 parts by mass or more, preferably 10 parts by mass or more, and more preferably 15 parts by mass or more.

<15> A method for producing a liquid developer as defined in any one of the above <1> to <14>, including:

step 1: melt-kneading a resin containing a resin H and a resin L and a pigment, and pulverizing a kneaded product obtained, to provide toner particles;

step 2: adding a dispersant to the toner particles obtained in the step 1, and dispersing the toner particles in a particular insulating liquid to provide a dispersion of toner particles; and step 3: subjecting the dispersion of toner particles obtained in the step 2 to wet-milling, to provide a liquid developer.

<16> The method for producing a liquid developer according to the above

<15>, wherein the dispersant contains a basic dispersant having a basic adsorbing group, and preferably a condensate of a polyimine and a carboxylic acid.

The present invention will be described hereinbelow more specifically by the Examples, without intending to limit the present invention to these Examples. The physical properties of the resins and the like were measured in accordance with the following methods.

[Softening Point of Resin]

Using a flow tester "CFT-500D," manufactured by Shimadzu Corporation, a 1 g sample is extruded through a nozzle having a diameter of 1 mm and a length of 1 mm with applying a load of 1.96 MPa thereto with a plunger, while heating the sample at a heating rate of 6° C./min. The softening point refers to a temperature at which half of the sample flows out, when plotting a downward movement of the plunger of the flow tester against temperature.

[Glass Transition Temperature of Resin]

Using a differential scanning calorimeter "DSC210," manufactured by Seiko Instruments Inc., a 0.01 to 0.02 g sample is weighed out in an aluminum pan, heated to 200° C., and cooled from that temperature to 0° C. at a cooling rate of 10° C./min. Next, the temperature of the sample is raised at a heating rate of 10° C./min to measure endothermic peaks. A temperature of an intersection of the extension of the baseline of equal to or lower than the highest temperature of endothermic peak and the tangential line showing the maximum inclination between the kick-off of the peak and the top of the peak is defined as a glass transition temperature.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Volume-Median Particle Size of Toner Particles Before Mixing with Insulating Liquid]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc.

Dispersion: EMULGEN 109P, manufactured by Kao Corporation, polyoxyethylene lauryl ether, HLB (Griffin): 13.6, is dissolved in the above electrolytic solution to adjust to a concentration of 5% by mass to provide a dispersion.

Dispersion Conditions: Ten milligrams of a measurement sample is added to 5 mL of the above dispersion, and the mixture is dispersed for 1 minute with an ultrasonic disperser (name of machine: US-1, manufactured by SND Co., Ltd., output: 80 W), and 25 mL of the above electrolytic solution is then added to the dispersion, and further dispersed with the ultrasonic disperser for 1 minute, to prepare a sample dispersion.

Measurement Conditions: The above sample dispersion is added to 100 mL of the above electrolytic solution to adjust to a concentration at which particle sizes of 30,000 particles can be measured in 20 seconds, and the 30,000 particles are measured, and a volume-median particle size $D_{50}$ is obtained from the particle size distribution.

[Conductivity of Insulating Liquid]

A 40 mL glass sample vial "Vial with screw cap, No. 7," manufactured by Maruemu Corporation is charged with 25 g of an insulating liquid. The conductivity is determined by immersing an electrode in an insulating liquid, taking 20 measurements for conductivity with a non-aqueous conductivity meter "DT-700," manufactured by Dispersion Technology, Inc., and calculating an average thereof. The smaller the numerical figures, the higher the resistance.

[Viscosities at 25° C. of Insulating Liquid and Liquid Developer]

A 10-mL glass sample vial with screw cap is charged with 6 to 7 mL of a measurement solution, and a viscosity at 25° C. is measured with a torsional oscillation type viscometer "VISCOMATE VM-10A-L," manufactured by SEKONIC CORPORATION.

[Boiling Point of Insulating Liquid]

Using a differential scanning calorimeter "DSC210," manufactured by Seiko Instruments Inc., a 6.0 to 8.0 g sample is weighed out in an aluminum pan, the temperature of the sample is raised to 350° C. at a heating rate of 10° C./min to measure endothermic peaks. The highest temperature side of the endothermic peak is defined as a boiling point.

[Weight-Average Molecular Weight (Mw) of Condensate of Polyimine and Carboxylic Acid]

The weight-average molecular weight is obtained by measuring a molecular weight distribution in accordance with a gel permeation chromatography (GPC) method.

(1) Preparation of Sample Solution

A dispersant is dissolved in chloroform so as to have a concentration of 0.2 g/100 mL. Next, this solution is filtered with a PTFE-type membrane filter "DISMIC-25JP," manufactured by Toyo Roshi Kaisha, Ltd., having a pore size of 0.20 μm, to remove insoluble components, to provide a sample solution.

(2) Molecular Weight Measurements

Using the following measurement apparatus and analyzing column, a chloroform solution of 100 mmol/L FARMIN DM2098 manufactured by Kao Corporation is allowed to flow through a column as an eluent at a flow rate of 1 mL per minute, the column is stabilized in a thermostat at 40° C., and 100 μl of a sample solution is loaded thereto to carry out measurements. The molecular weight of the sample is calculated based on the previously drawn calibration curve. At this time, a calibration curve is drawn from several kinds of monodisperse polystyrenes, manufactured by Tosoh Corporation, A-500 (Mw: $5.0\times10^2$), A-5000 (Mw: $5.97\times10^3$), F-2 (Mw: $1.81\times10^4$), F-10 (Mw: $9.64\times10^4$), and F-40 (Mw: $4.27\times10^5$) as standard samples. The values within the parentheses show molecular weights.

Measurement Apparatus: HLC-8220GPC, manufactured by Tosoh Corporation

Analyzing Column: K-804L, manufactured by SHOWA DENKO CORPORATION

[Solid Content Concentrations of Dispersion of Toner Particles and Liquid Developer]

Ten parts by mass of a sample is diluted with 90 parts by mass of hexane, and the dilution is spun with a centrifuge "H-201F," manufactured by KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and a lower layer is then dried with a vacuum dryer at 0.5 kPa and 40° C. for 8 hours. The solid content concentration is calculated according to the following formula:

$$\text{Solid Content Concentration, \% by Mass} = \frac{\text{Mass of Residues After Drying}}{\text{Mass of Sample, Corresponding to 10 Parts by Mass Portion}} \times 100$$

[Volume-Median Particle Size $D_{50}$ of Toner Particles in Liquid Developer]

A volume-median particle size $D_{50}$ is determined with a laser diffraction/scattering particle size measurement instrument "Mastersizer 2000," manufactured by Malvern Instruments, Ltd., by charging a cell for measurement with Isopar L, manufactured by Exxon Mobile Corporation, isoparaffin, viscosity at 25° C. of 1 mPa·s, under conditions that a particle refractive index is 1.58, imaginary part being 0.1, and a dispersion medium refractive index is 1.42, at a concentration that gives a scattering intensity of from 5 to 15%.

Production Example 1 of Resins—Composite Resins A to C

A 10-L four-necked flask equipped with a nitrogen inlet tube, a dehydration tube, a stirrer, and a thermocouple was charged with raw material monomers for a polyester resin other than fumaric acid and trimellitic anhydride listed in Table 1, an esterification catalyst, and an esterification promoter, and the temperature of the contents was raised to 230° C. with a mantle heater. Thereafter, the mixture was reacted at 230° C. for 8 hours, and further reacted at a reduced pressure of 8.3 kPa for 1 hour.

The temperature of the contents was lowered to 170° C., and raw material monomers for a styrenic resin, a dually reactive monomer, and a polymerization initiator as listed in Table 1 were added dropwise from a dropping funnel over 1 hour. After holding the temperature at 170° C., the addition polymerization reaction was aged for 1 hour, and the temperature was then raised to 210° C. The raw material monomers for a styrenic resin were removed and the dually reactive monomer was reacted with a polyester site at 8.3 kPa for 1 hour.

Further, trimellitic anhydride, fumaric acid, and 5 g of a polymerization inhibitor were added thereto at 210° C., and the reaction mixture was reacted until a softening point as listed in Table 1 was reached, to provide each of composite resins having physical properties as shown in Table 1.

Production Example 2 of Resins—Polyester Resins A and B

A 10-L four-necked flask equipped with a nitrogen inlet tube, a dehydration tube, a stirrer, and a thermocouple was charged with raw material monomers for a polyester resin other than fumaric acid and trimellitic anhydride listed in Table 1, an esterification catalyst, and an esterification promoter, and the temperature of the contents was raised to 230° C. with a mantle heater. Thereafter, the mixture was reacted at 230° C. for 8 hours, and further reacted at a reduced pressure of 8.3 kPa for 1 hour.

Further, trimellitic anhydride, fumaric acid, and 5 g of a polymerization inhibitor were added thereto at 210° C., and the reaction mixture was reacted until a softening point as listed in Table 1 was reached, to provide each of polyester resins having physical properties as shown in Table 1.

TABLE 1

| | | Composite Resin A | Composite Resin B | Composite Resin C | Polyester Resin A | Polyester Resin B |
|---|---|---|---|---|---|---|
| Raw Material Monomers for Polyester Resin | BPA-PO[1)] | 3,357 g (50) | 4,657 g (70) | 4,046 g (70) | 3,720 g (50) | 5,198 g (70) |
| | BPA-EO[2)] | 3,117 g (50) | 1,853 g (30) | 1,610 g (30) | 3,455 g (50) | 2,069 g (30) |
| | Terephthalic Acid | 2,101 g (66) | 852 g (27) | 1,288 g (47) | 2,399 g (66) | 951 g (27) |
| | Fumaric Acid | 89 g (4) | 794 g (36) | — | 99 g (4) | 886 g (36) |
| | Trimellitic Anhydride | 295 g (8) | 803 g (22) | 729 g (23) | 327 g (8) | 896 g (22) |
| | Dodecenylsuccinic Anhydride | — | — | 791 g (18) | — | — |
| Dually Reactive Monomer | Acrylic Acid | 41 g (3) | 41 g (3) | 36 g (3) | — | — |
| Raw Material Monomers for Styrenic Resin | Styrene | 749 g (84) | 745 g (84) | 1,112 g (84) | — | — |
| | 2-Ethylhexyl Acrylate | 143 g (16) | 142 g (16) | 212 g (16) | — | — |
| Polymerization Initiator | Dibutyl Peroxide | 54 g (6) | 53 g (6) | 79 g (6) | — | — |
| Esterification Catalyst | Tin(II) 2-Ethylhexanoate | 45 g | 45 g | 45 g | 45 g | 45 g |
| Esterification Promoter | Gallic Acid | 1 g | 1 g | 1 g | 1 g | 1 g |
| Polymerization Inhibitor | 4-t-Butylcetechol | 5 g | 5 g | 5 g | — | — |
| Reaction Water Produced by Polycondensation Reaction, Calculated Value | | 549 g | 592 g | 595 g | 612 g | 649 g |
| Polyester Resin/Styrenic Resin, Mass Ratio | | 10/90 | 10/90 | 15/85 | — | — |
| Physical Properties of Resin | Softening Point, ° C. | 90 | 104 | 113 | 90 | 102 |
| | Glass Transition Temperature, ° C. | 50 | 59 | 58 | 52 | 59 |
| | Acid Value, mgKOH/g | 18 | 34 | 26 | 15 | 35 |

Note)

The numerical figures inside the parentheses in the raw material monomers for a polyester resin are expressed by a molar ratio when a total number of moles of alcohol component is defined as 100. Also, the numerical figures inside the parentheses in the raw material monomers for a styrenic resin and a polymerization initiator are expressed by a mass ratio.

[1)]BPA-PO: Polyoxypropylene(2.2)-2,2-bis(4-hydroxyphenyl)propane

[2)]BPA-EO: Polyoxyethylene(2.2)-2,2-bis(4-hydroxyphenyl)propane

Examples 1 to 5 and Comparative Examples 1 to 3

Eighty parts by mass of a resin as listed in Table 2 and 20 parts by mass of a pigment "ECB-301" manufactured by DAINICHISEIKA COLOR & CHEMICALS MFG. CO., LTD., Phthalocyanine Blue 15:3, were previously mixed with a 20-L Henschel mixer while stirring for 3 minutes at a rotational speed of 1,500 r/min (peripheral speed 21.6 m/sec), and the mixture was then melt-kneaded under the conditions given below.

[Melt-Kneading Conditions]

A continuous twin open-roller type kneader "Kneadex," manufactured by NIPPON COKE & ENGINEERING CO., LTD. having an outer diameter of roller of 14 cm and an effective length of roller of 55 cm was used. The operating conditions of the continuous twin open-roller type kneader were a high-rotation roller (front roller) with a peripheral speed of 75 r/min (32.4 in/min), a low-rotation roller (back roller) with a peripheral speed of 35 r/min (15.0 m/min), and a gap between the rollers at an end of the kneaded product-supplying side of 0.1 mm. The temperatures of the heating medium and the cooling medium inside the rollers were as follows. The high-rotation roller had a temperature at the raw material supplying side of 90° C., and a temperature at the kneaded product-discharging side of 85° C., and the low-rotation roller had a temperature at the raw material supplying side of 35° C., and a temperature at the kneaded product-discharging side of 35° C. In addition, the feeding rate of the raw material mixture to the kneader was 10 kg/h, and the average residence time in the kneader was about 3 minutes.

The kneaded product obtained above was roll-cooled with a cooling roller, and the cooled product was roughly pulverized with a hammer-mill to a size of 1 mm or so, and then finely pulverized and classified with an air jet mill "IDS," manufactured by Nippon Pneumatic Mfg. Co., Ltd., to provide toner particles having a volume-median particle size $D_{50}$ of 10 μm.

A 1-L polyethylene vessel was charged with 35 parts by mass of toner particles obtained, 62.9 parts by mass of an insulating liquid "NAS-4" manufactured by NOF Corporation, a polyisobutene having a conductivity of $1.52\times10^{-12}$ S/m, a boiling point of 247° C., and a viscosity at 25° C. of 2 mPa·s, and 2.1 parts by mass of a basic dispersant "SOLSPARSE 11200," manufactured by Lubrizol Corporation, a condensate of a polyimine and a carboxylic acid having an effective content of 50% and a weight-average molecular weight of 10,400, and the contents were stirred with "T.K. ROBOMIX," manufactured by PRIMIX Corporation, under ice-cooling at a rotational speed of 7,000 r/min for 30 minutes, to provide a dispersion of toner particles having a solid content concentration of 36% by mass.

Next, the dispersion of toner particles obtained was subjected to wet-milling with 6 vessels-type sand mill "TSG-6," manufactured by AIMEX CO., LTD., at a rotational speed of 1,300 r/min (peripheral speed 4.8 m/sec) using zirconia beads having a diameter of 0.8 mm at a volume filling ratio of 60% by volume, so as to give toner particles having a volume-median particle size $D_{50}$ as listed in Table 2. The beads were removed by filtration, and the filtrate was diluted with an insulating liquid "NAS-4" manufactured by NOF Corporation in an amount of 40 parts by mass based on 100 parts by mass of the filtrate, to provide a liquid developer having a solid content concentration of 26% by mass and having physical properties as shown in Table 2.

TABLE 2

| | Resin | | | | | | Liquid Developer | | | |
|---|---|---|---|---|---|---|---|---|---|---|
| | Resin H | | | Resin L | | | | | | |
| | Kinds | Softening Point, ° C. | Amount Used, Parts by Mass | Kinds | Softening Point, ° C. | Amount Used, Parts by Mass | $D_{50}$ of Toner Particles, μm | Viscosity, mPa · s | Fusing Ability: Fusing Temp., ° C. | Fusing Ability: Fusing Range, ° C. |
| Example 1 | Composite Resin B | 104 | 40 | Composite Resin A | 90 | 40 | 2.5 | 12 | 100 to 150 | 50 |
| Example 2 | Composite Resin C | 113 | 40 | Composite Resin A | 90 | 40 | 2.7 | 20 | 100 to 150 | 50 |
| Example 3 | Composite Resin B | 104 | 53 | Composite Resin A | 90 | 27 | 2.7 | 27 | 100 to 150 | 50 |
| Example 4 | Composite Resin B | 104 | 27 | Composite Resin A | 90 | 53 | 2.7 | 15 | 90 to 140 | 50 |
| Example 5 | Composite Resin B | 104 | 40 | Polyester Resin A | 90 | 40 | 2.9 | 29 | 90 to 140 | 50 |
| Comparative Example 1 | — | — | — | Composite Resin A | 90 | 80 | 2.5 | 10 | 90 to 120 | 30 |
| Comparative Example 2 | Composite Resin B | 104 | 80 | — | — | — | 3.3 | 32 | 140 to 160 | 20 |
| Comparative Example 3 | Polyester Resin B | 102 | 40 | Polyester Resin A | 90 | 40 | 3.5 | 45 | 90 to 140 | 50 |

Test Example 1—Fusing Ability

A liquid developer was dropped on "POD Gloss Coated Paper" manufactured by Oji Paper Co., Ltd., a thin film was produced with a wire bar, so as to have the mass on a dry basis of 1.2 g/m$^2$. Thereafter, the produced thin film was held in a thermostat at 80° C. for 10 seconds.

Next, a fusing treatment was carried out at a fusing roller temperature of 80° C. and a fusing speed of 280 mm/sec, with a fuser taken out of "OKI MICROLINE 3010," manufactured by Oki Data Corporation. Thereafter, the same fusing treatment as mentioned above was carried out at each temperature while raising the fusing roller temperature up to 160° C. with an increment of 10° C., to provide fused images at each temperature.

The fused images obtained were adhered to a mending tape "Scotch Mending Tape 810," manufactured by 3M, width of 18 mm, the tape was pressed with a roller so as to apply a load of 500 g thereto, and the tape was then removed. The optical densities before and after tape removal were measured with a colorimeter "GretagMacbeth Spectroeye," manufactured by Gretag. The fused image-printed portions were measured at 3 points each, and an average thereof was calculated as an optical density. A fusing ratio (%) was calculated by [optical density after removal]/[optical density before removal]×100. A temperature range in which a fusing ratio reaches 90% or more and an offset is not generated is defined as a fusing temperature. A value obtained by subtracting the lower limit of the fusing temperature from the upper limit thereof is defined as a fusing range. The results are shown in Table 2. The larger the numerical value, the broader the fusing range.

It can be seen from the above results that the liquid developers of Examples 1 to 5 have smaller particle sizes and low viscosities, and fusible at broader temperature ranges.

On the other hand, it can be seen that the liquid developers of Comparative Examples 1 and 2 where only one kind of a composite resin is used have a narrow fusible temperature range, and that even when resins have different softening points, the liquid developer of Comparative Example 3 where the polyester resins are combined have a large particle size and high viscosity even though its fusible temperature range is broader.

The liquid developer of the present invention is suitably used in development or the like of latent images formed in, for example, electrophotography, electrostatic recording method, electrostatic printing method or the like.

The invention claimed is:

1. A method for producing a liquid developer, wherein the liquid developer comprises toner particles comprising a resin and a pigment, wherein the toner particles are dispersed in an insulating liquid, wherein the resin comprises a resin H having a softening point of 100° C. to 130° C. and a resin L having a softening point of 70° C. to 93° C., wherein the resin H is a composite resin HC of a polyester resin and a styrenic resin, and the resin L is a composite resin LC of a polyester resin and a styrenic resin, wherein the composite resin HC and the composite resin LC are each a resin in which a polyester resin and a styrenic resin are chemically bonded via a dually reactive monomer, the method comprising:

melt-kneading a resin comprising a resin H and a resin L and a pigment, and pulverizing a kneaded product obtained, to obtain toner particles;

adding a dispersant to the toner particles, and dispersing the toner particles in an insulating liquid to obtain a dispersion of toner particles; and subjecting the dispersion of toner particles to wet-milling, to obtain a liquid developer, wherein a mass ratio of the resin H to the resin L, resin H/resin L, is in a range of 3/7 to 6/4.

2. The method for producing a liquid developer according to claim 1, wherein a difference in softening points between the resin H and the resin L is 10° C. to 35° C.

3. The method for producing a liquid developer according to claim 1, wherein the polyester resin in the composite resin HC and the composite resin LC is a polycondensate of an alcohol component comprising a dihydric or higher polyhydric alcohol and a carboxylic acid component comprising a dicarboxylic or higher polycarboxylic acid compound.

4. The method for producing a liquid developer according to claim 3, wherein the alcohol component comprises at least one dihydric alcohol selected from the group consisting of a diol having 2 to 20 carbon atoms, and an alkylene oxide adduct of bisphenol A represented by formula (I):

(I)

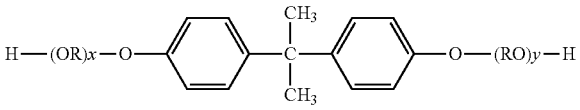

wherein RO and OR are an oxyalkylene group, wherein R is an ethylene group and/or a propylene group; and each of x and y is a positive number showing a number of moles of alkylene oxide added, wherein an average value of the sum of x and y is 1 to 16.

5. The method for producing a liquid developer according to claim 3, wherein the carboxylic acid component comprises at least one dicarboxylic acid compound selected from the group consisting of dicarboxylic acids having 3 to 30 carbon atoms, anhydrides thereof, alkyl esters thereof, the alkyl having 1 to 3 carbon atoms.

6. The method for producing a liquid developer according to claim 1, wherein the dually reactive monomer is a compound having within the molecule at least one functional group selected from the group consisting of a hydroxyl group, a carboxy group, an epoxy group, a primary amino group, and a secondary amino group.

7. The method for producing a liquid developer according to claim 1, wherein the dually reactive monomer is at least one member selected from the group consisting of acrylic acid, methacrylic acid, fumaric acid, maleic acid, and maleic anhydride.

8. The method for producing a liquid developer according to claim 1, wherein the insulating liquid is one or more members selected from the group consisting of hydrocarbon solvents, polysiloxanes, and vegetable oils.

9. The method for producing a liquid developer according to claim 1, wherein the dispersant comprises a basic dispersant having a basic adsorbing group.

10. The method for producing a liquid developer according to claim 9, wherein the basic dispersant is a condensate of a polyimine and a carboxylic acid.

* * * * *